US005775442A

United States Patent [19]

Speed

[11] Patent Number: 5,775,442

[45] Date of Patent: Jul. 7, 1998

[54] RECOVERY OF GAS FROM DRILLING FLUID RETURNS IN UNDERBALANCED DRILLING

[75] Inventor: David Speed, Calgary, Canada

[73] Assignee: Northland Production Testing, Ltd., Alberta, Canada

[21] Appl. No.: 741,201

[22] Filed: Oct. 29, 1996

[51] Int. Cl.[6] ..... E21B 21/06; E21B 21/08; E21B 21/14; E21B 49/00

[52] U.S. Cl. ..... 175/48; 55/346; 95/269; 95/271; 210/788; 175/66; 175/71; 175/206; 175/212; 175/218

[58] Field of Search ..... 166/267; 175/48, 175/66, 69, 71, 206, 207, 212, 217, 218; 55/346, 349, 459.1; 95/268, 269, 271; 96/188; 210/788

[56] References Cited

U.S. PATENT DOCUMENTS

| | | | |
|---|---|---|---|
| 2,923,151 | 2/1960 | Engle et al. | 175/206 X |
| 3,172,487 | 3/1965 | Klotz | 175/71 X |
| 3,500,943 | 3/1970 | Bingman, Jr. | 175/66 |
| 3,633,687 | 1/1972 | West et al. | 175/48 |
| 4,577,700 | 3/1986 | Dellinger et al. | 175/212 X |
| 4,666,471 | 5/1987 | Cates | 175/66 X |
| 5,129,468 | 7/1992 | Parmenter | 175/66 |
| 5,249,635 | 10/1993 | King et al. | 175/48 |
| 5,415,776 | 5/1995 | Homan | 210/519 |
| 5,663,121 | 9/1997 | Moody | 175/71 X |

*Primary Examiner*—George A. Suchfield
*Attorney, Agent, or Firm*—Millen, White, Zelano & Branigan, P.C.

[57] ABSTRACT

The drilling fluid returns from underbalanced drilling are introduced into a separator and a separate gas stream is recovered. The gas stream is cleaned at the well site to remove entrained liquid and particulate solids, to produce gas suitable to be fed to a compressor. The cleaned gas is compressed to re-injection pressure and recycled to the well.

3 Claims, 5 Drawing Sheets

RECOVERY OF GAS FROM DRILLING FLUID RETURNS IN UNDERBALANCED DRILLING

FIELD OF THE INVENTION

This invention relates to a process for recovering gas from drilling fluid returning from a well undergoing underbalanced drilling, cleaning the gas by removing entrained particulate solids and liquid, re-compressing the cleaned gas and re-injecting it into the well.

BACKGROUND OF THE INVENTION

Wells have long been drilled using drilling mud as the circulating medium. The drilling mud performs two functions: it provides a column of heavy fluid that exerts hydrostatic pressure at the bottom of the wellbore, to prevent entry into the wellbore of pressurized hydrocarbons present in the formation being drilled; and it serves to carry rock cuttings up and out of the wellbore.

When drilling mud is used, there is a likelihood that it will penetrate out into a porous and permeable, hydrocarbon-containing reservoir when the reservoir is being opened up or drilled through. When this occurs, the productivity of the well can be adversely affected. The mud that has penetrated radially into the formation acts to impede the flow of hydrocarbons into the wellbore.

A technique called underbalanced drilling has been developed in recent years to overcome this problem. Typically, the well is completed with casing to the top of the pay zone. When drilling is initiated into the pay zone, a drilling fluid (commonly water or diesel fuel) is lightened with an added gas (usually nitrogen) and is used as the circulating medium. The nitrogen may be introduced at surface into the drill string or it may be introduced at the base of the drill string through a parasite string.

The pressurized returns from a well undergoing underbalanced drilling normally comprise drilling fluid, water, rock cuttings and gas (including added gas). If the well penetrates a formation containing hydrocarbons, then the returns can also contain liquid and gaseous hydrocarbons. The pressurized returns are conveyed into a closed pressure vessel separator. In this separator, the gases contained in the wellhead returns separate and leave, together with some entrained particulate solids and liquids, as an overhead stream. The drilling fluid, water, liquid hydrocarbons and cuttings also separate out in the separator and are recovered as separate streams.

Heretofore, the overhead gas stream has been flared or vented.

Typically, the overhead gas stream comprises added gas, usually nitrogen, hydrocarbons (in gaseous or entrained liquid forms), water (in gaseous or entrained liquid forms), and a small amount of fine solids.

Since nitrogen costs can add up to 20% to 30% of the cost of drilling a well, it is to the best interest of the operating company to recover the nitrogen, so that it can be recycled back into the well.

It is the objective of the invention to provide a system for treating the separator gas stream so that it can be recycled back into the well.

SUMMARY OF THE INVENTION

In general, the invention involves a process comprising:

feeding pressurized underbalanced drilling fluid returns to a closed pressure vessel separator and separating rock cuttings, liquids and gases to produce separate streams thereof from said returns separator;

cleaning the gas stream under pressure to remove entrained liquids and fine solids and produce a pressurized gas stream of sufficient quality to be fed to a compressor;

compressing the cleaned gas to well re-injection pressure; and re-injecting the cleaned gas into the well as added gas.

From the foregoing it will be noted that a closed or pressure-containing system is used to carry out separation, cleaning, compression and re-introduction into the well.

In connection with this general process, certain difficulties needed to be addressed. More particularly:

the gas cleaning circuit is to be employed at a wellsite and thus should involve simple, moveable, rugged equipment having a minimum of moving parts;

the flow rate of gas in the drilling fluid returns can be excessive. This gas flow can overwhelm the cleaning circuit or exceed the gas needs for the drilling fluid. Thus there is a need for a controlled flare system for venting excess gas; and the flow rate of gas in the drilling fluid returns can be inadequate to meet the needs of the cleaning circuit, with the result that gas velocity through the cleaning circuit may need adjustment and make-up added gas may be required.

We have successfully combined a centrifugal vertical recycling separator, a filter/coalescer and a centrifugal in-line separator in sequence to clean the returns separator gas. All of these components are individually known and are commercially available. The vertical recycling separator removes most of the liquid from the gas stream, so that it will not deleteriously affect the downstream units; the filter/coalescer removes entrained fine solids and coalesces liquid droplets; and the in-line centrifugal separator removes the residual traces of liquid. This cleaning circuit involves no moving parts in the main vessels. To our knowledge, the combination of units has not been made before. It is a rugged system that successfully deals with the variable flows and yields a sufficiently clean product which can be used as feed to a compressor. However, it is to be understood that this assembly is only preferred as the cleaning circuit.

We have also found that when the separator gas stream flow rate is low, cleaning efficiency in the cleaning circuit is inadequate.

Having noted this, we provided a preferred circuit which incorporates the following features:

monitoring the pressure and temperature of the gas stream leaving the returns separator, to determine a measure indicative of its flow rate;

diverting part or all of the separator gas stream to a flare stack, if the gas flow rate is excessive;

providing pairs of trains, each comprising a vertical recycling separator, a filter/coalescer and a centrifugal in-line separator, in parallel, so that the flow to one can be terminated or throttled to increase the flow rate to the other, to cope with situations where the separator gas stream flow rate is low, so as to maintain gas velocity and cleaning efficiency; and providing a source of make-up added gas for addition, should the returns separator gas stream flow rate be insufficient to lighten the drilling fluid to the extent required.

DESCRIPTION OF THE PREFERRED EMBODIMENT

Figure 1:
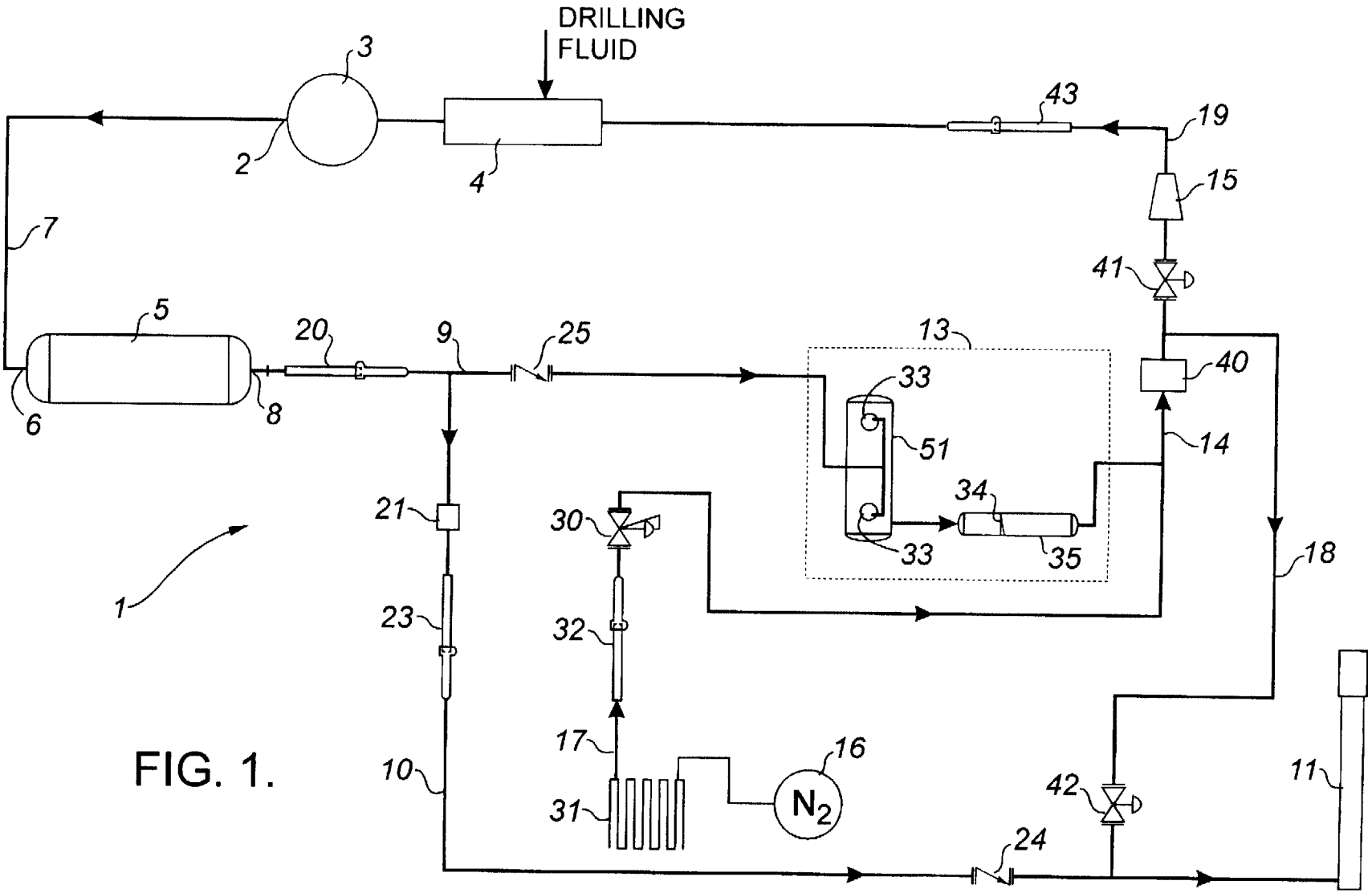
FIG. 1 is a schematic showing a circuit for practising the process of the invention.

A pressure-containing loop circuit 1 connects the drilling fluid returns outlet 2 of a well 3 undergoing underbalanced drilling, with the drilling fluid feed assembly 4 of the well. The feed assembly 4 comprises inlet means for introducing lightened drilling fluid into the well.

The circuit 1 comprises a pressure vessel separator 5 having an inlet 6 connected by a line 7 with the well outlet 2. The separator 5 is described in U.S. Pat. No. 5,415,776, issued to the assignee of the present application. The disclosure of this patent is incorporated herewith by reference.

The drilling fluid returns are processed in the separator 5 to produce separate streams of liquid, rock cuttings and gas.

The gas stream is discharged from the separator 5 through an outlet 8 and line 9. The gas stream typically is at a pressure of 30 psig. The gas stream varies in composition but usually includes added gas (normally nitrogen) and small amounts of entrained fine solids and liquid.

The separator gas line 9 connects with a flare line 10 that leads to and is connected with a flare stack 11. Line 9 also connects with the upstream end of a gas cleaning circuit 13. The downstream end of the cleaning circuit 13 is connected by a line 14 with the inlet of a compressor 15. A pressure vessel 16 containing make-up nitrogen is connected by line 17 with line 14. A bypass line 18 connects line 14 with flare line 10. And the outlet of the compressor 15 is connected by a line 19 with the well feed assembly 4.

In greater detail, the line 9 leading from the separator gas outlet 8 comprises an orifice plate meter 20, for measuring the flow rate of the gas stream produced by the returns separator 5.

The flare line 10 comprises a pneumatic pressure-sensing valve 21. The drilling fluid returns periodically enter and leave the separator 5 at varying rates and pressures, due to slug flow conditions arising from the well 3. If the valve 21 senses that the pressure in line 9 is greater than the expected separator pressure, then it throttles open to relieve pressure and transfer excess gas to the flare stack 11.

An orifice flow meter 23 is positioned in the flare line 10, to record gas flow therethrough. Check valves 24, 25 are positioned in the flare line 10 and the line 9, for preventing back-flash or back-flow, respectively.

A second pneumatic pressure sensing valve 30 is positioned in the nitrogen make-up line 17. If the pressure in the line 9 falls below a predetermined value (e.g. 30 psig), then valve 30 opens to allow make-up gas to be added to the gas stream.

The heater 31 is provided in nitrogen make-up line 17 to equalize the temperature of the added nitrogen with that of the main gas stream. A flow meter 32 monitors the flow of make-up nitrogen to record the amount supplied.

Figure 4:
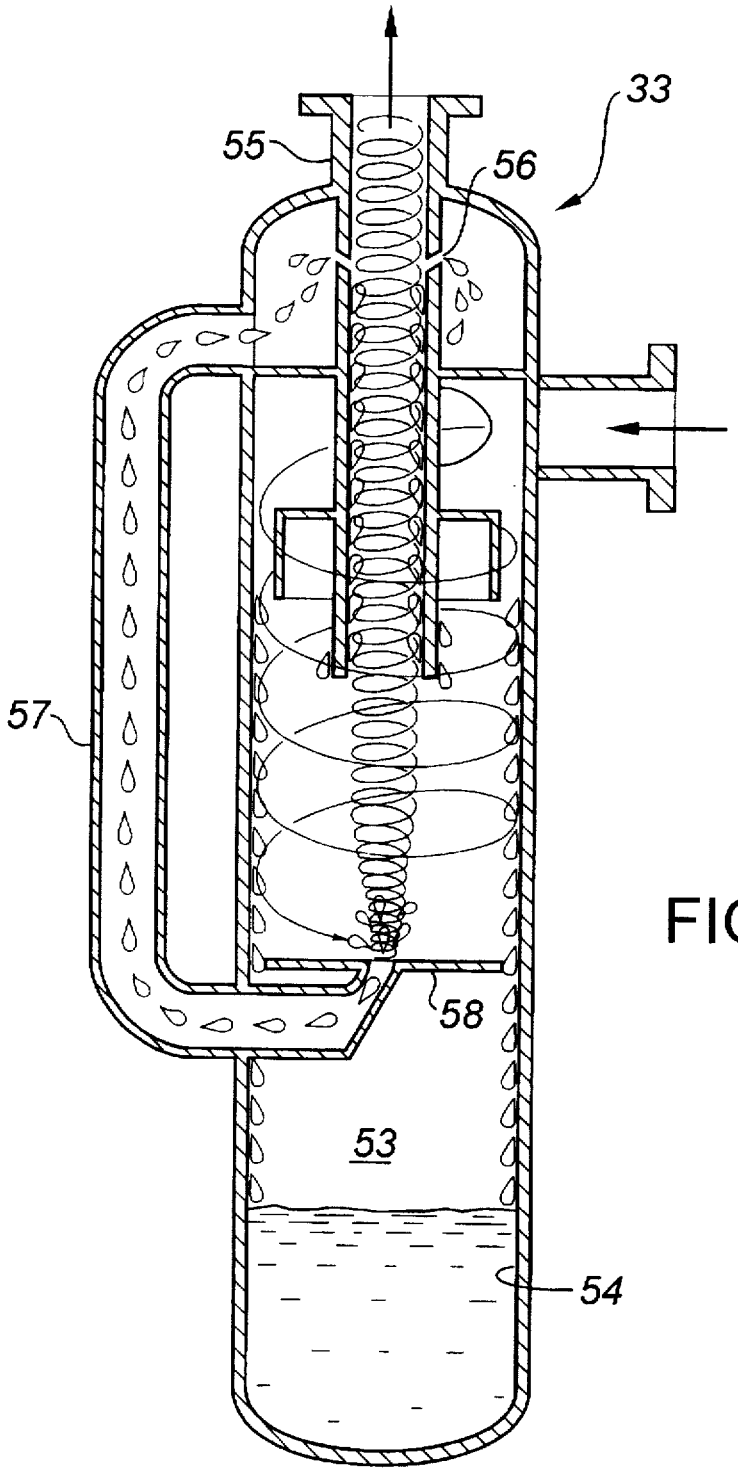
FIG. 4 is a sectional drawing showing a vertical recycling centrifugal separator.
Figure 5:
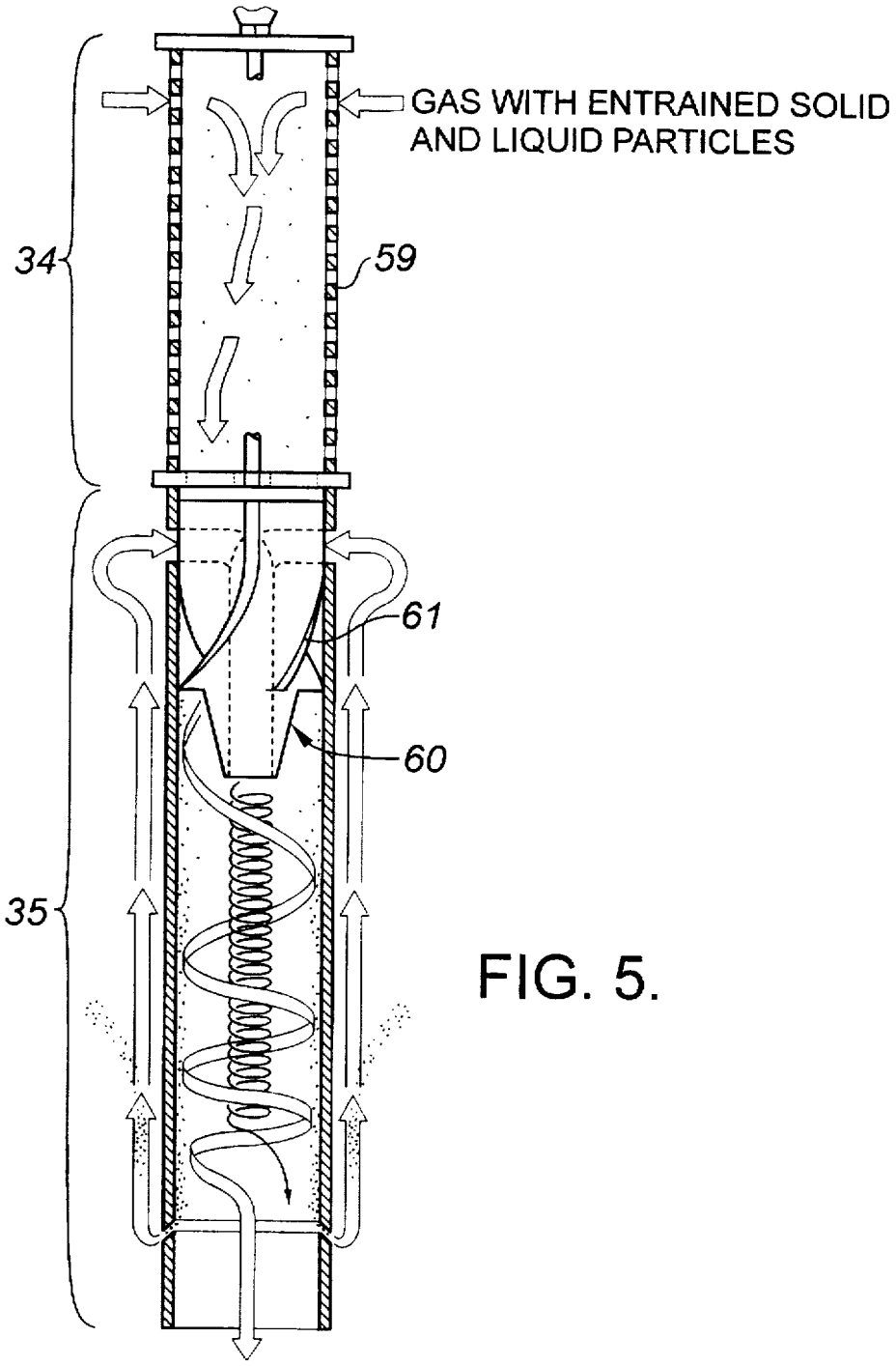
FIG. 5 is a sectional drawing showing a filter/coalescer and centrifugal in-line separator in series.

The cleaning circuit 13 comprises a combination of a vertical recycling centrifugal separator, a filter/coalescer and a centrifugal in-line separator, connected in series. These are commercially available units available from Porta-Test International Inc., Edmonton, Alberta. The units are shown in section in FIGS. 4 and 5.

Figure 2:
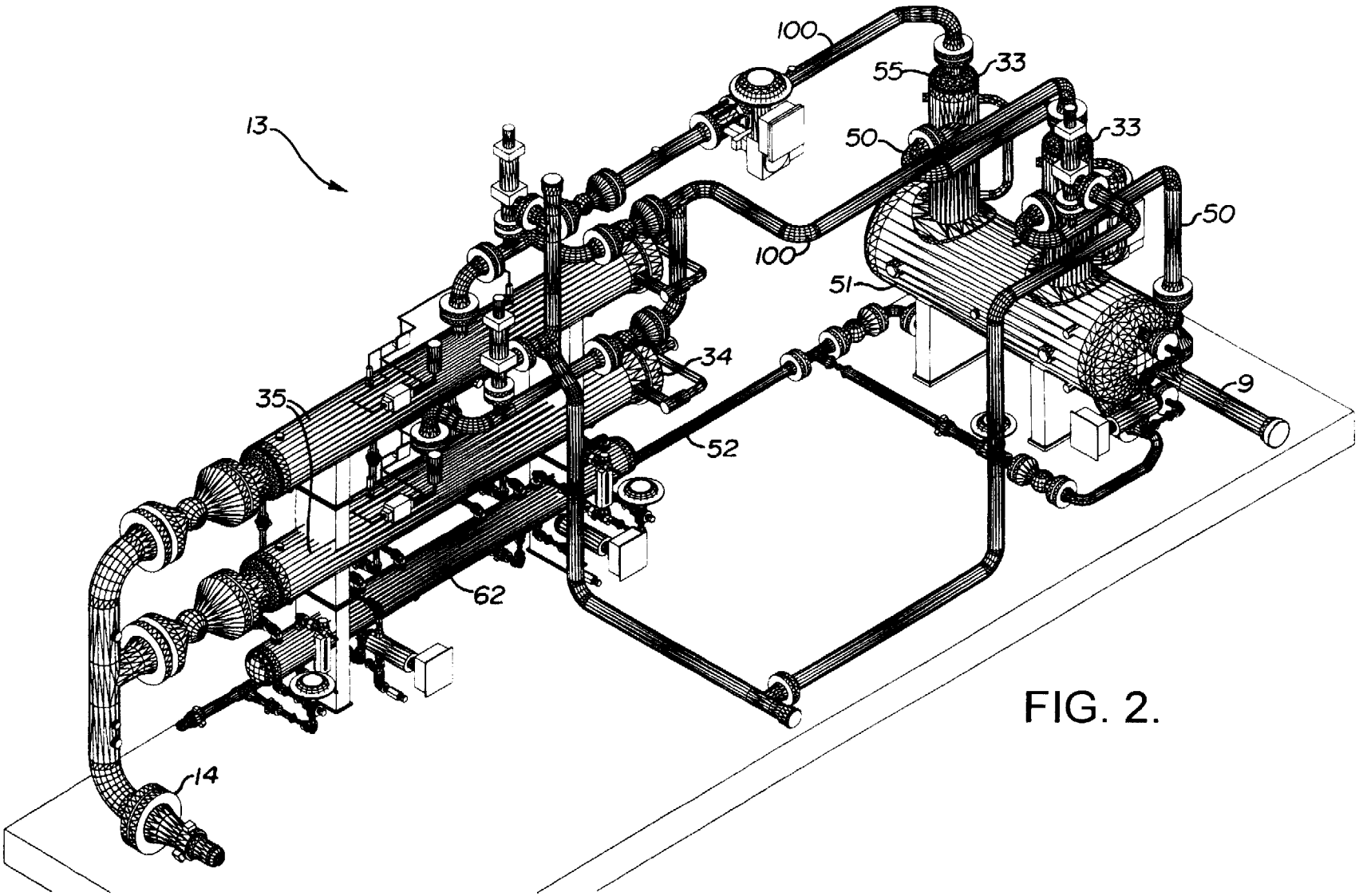
FIG. 2 is an isometric view of the cleaning circuit.
Figure 3:
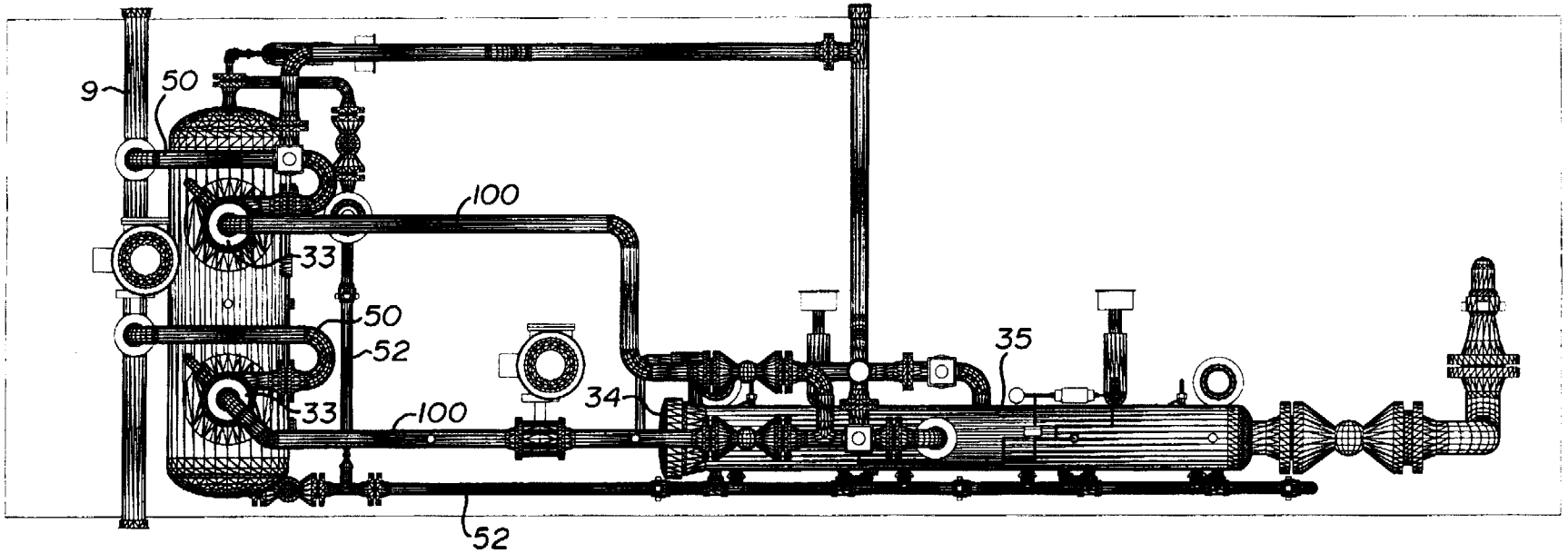
FIG. 3 is a plan view of the cleaning circuit of FIG. 2.

Having reference to FIGS. 2 and 3, the gas line 9 from the returns separator 5 is connected to a pair of vertical recycling centrifugal separators 33 by risers 50. Each vertical separator 33 is supported in and discharges separated liquid into a sump vessel 51. Liquid is periodically dumped from sump vessel 51 through a discharge line 52.

The gas from each riser 50 is fed tangentially into the vertical separator 33 with which it is connected. The gas stream spins on entering the separator vessel chamber 53 and liquid is spun out to the vessel wall 54 while the gas forms a central vortex that discharges through the vortex finder 55. Liquid traces creeping along the inside of the vortex finder are sucked through the gap 56 and returned to the chamber 53 through line 57. This line 57 terminates at a central opening in a baffle plate 58.

The gas stream issuing from the vortex finder 55 of each vertical separator 33 is fed through a line 100 to one of a pair of horizontal filter/coalescers 34, each having a glass fiber filter element 59. Here the contained solid particles are retained by the filter element 59 and some coalescence of remaining liquid drops occurs. These liquid droplets pass through the filter element together with the gas.

The gas stream moves directly from each filter/coalescer 34 into a downstream centrifugal in-line separator 35. Here the stream is spun by flowing past a device 60 having twisted vanes 61. (This device is referred to as a "whirly jig".) Residual liquid is spun out and is sucked out through a gap in the vessel wall. This liquid is collected in a sump tank 62 which can be dumped through line 52. The cleaned gas is discharged from the in-line separators 35 into line 14.

It is found that the cleaned gas stream leaving the cleaning circuit 13 is sufficiently cleaned so that the liquid content is reduced to the order of 0.1% and the solids particle size is reduced to the order of 0.5 micron, depending on filter specification. The gas is suitable for compression in the compressor 15.

The line 14 extending between the cleaning circuit 13 and the compressor 15 has a dew point tester 40 and a valve 41. The bypass line 18 is connected to line 14 between these two units and has a valve 42. If the dew point tester 40 measures a moisture content greater than a predetermined value, it activates closing of main line valve 41 and opens bypass valve 42, allowing the gas to be flared or vented until the variation is corrected.

The compressor 15 increases the pressure of the cleaned gas stream to that required for re-injection into the well. Typically it increases the pressure to about 2000 psig.

The compressed cleaned gas stream passes through the feed line 19 to the well feed assembly 4 for re-introduction into the well 3. The flow rate of the stream is measured by the flow meter 43.

In operation, the drilling returns from the well 3 are fed to the returns separator 5 and a stream of gas containing small amounts of liquid and solids is produced. This gas stream flows through one of the vertical recycling centrifugal separators 33, to remove almost all of the entrained liquid, so that the downstream filter/coalescer 34 and in-line centrifugal separator 35 will not be flooded. The substantially dry gas stream then has the solids removed by the filter element of the filter/coalescer 34 and the remaining liquid droplets are coalesced. The gas stream then passes through the in-line centrifugal separator 35 to remove traces of liquid. The cleaned gas has additional nitrogen added, if needed. The cleaned gas is then compressed and returned to the well through the assembly 4 as added gas in the drilling fluid.

The pressure of the stream leaving the returns separator 5 is monitored. If the pressure, and thus the gas flow rate, is excessive then the flare line is opened to flare excess gas. If the pressure is too low, then make-up nitrogen is added to maintain the flow rate at a desired level so that the cleaning circuit is efficient. As indicated, there are two trains of units 33, 34, 35 so that one can be closed down if flow rate is low, to satisfy the minimum flow rate needs of one train.

The scope of the invention is set forth in the claims now following.

The embodiments of the invention in which an exclusive property or privilege is claimed are defined as follows:

1. A method for treating pressurized drilling fluid returns from a well having a returns outlet and inlet means for introducing drilling fluid and added gas to the well, said well undergoing underbalanced drilling, said returns comprising a liquid component, a particulate solids component and a gas component comprising added gas, said method comprising:

providing a pressure-containing loop circuit extending between and connected with the returns outlet and inlet means, said circuit comprising a separator vessel, a circuit for cleaning gas and a compressor;

introducing the returns into the separator vessel, separating the solids, liquid and gas components in the vessel and producing separate solids, liquid and gas streams from the vessel, said gas stream containing minor amounts of entrained solids and liquid;

separating sufficient entrained solids and liquid from the gas stream in the cleaning circuit to produce cleaned gas acceptable as compressor feed; and compressing cleaned gas in the compressor to well re-injection pressure and recycling it to the well as added gas.

2. A method for treating pressurized drilling fluid returns from a well having a returns outlet and inlet means for introducing drilling fluid and added gas to the well, said well undergoing underbalanced drilling, said returns comprising a liquid component, a particulate solids component and a gas component comprising added gas, said method comprising:

providing a pressure-containing loop circuit extending between and connected with the returns outlet means and inlet means, said circuit comprising a separator vessel, said vessel having a returns inlet and outlets for producing separate liquid, solids and gas streams, means for separating minor amounts of entrained solids and liquid from the gas stream, said separating means having an inlet and outlet, a compressor having an inlet and outlet, a flare stack, a first line connecting the well outlet means with the vessel returns inlet, second and third lines connecting the vessel gas outlet with each of the separating means inlet and the flare stack, a fourth line connecting the separating means outlet with the compressor inlet, a fifth line connecting the compressor outlet and the well inlet means, means for monitoring the flow rate of the gas stream leaving the vessel, valve means controlling each of the second and third lines, a source of make-up added gas, a sixth line connecting the make-up gas source with the circuit and valve means for controlling the sixth line;

introducing the returns through the first line into the vessel inlet, separating the solids, liquid and gas components in the vessel and producing separate solids, liquid and gas streams through the vessel outlets, said gas containing minor amounts of entrained solids and liquid;

monitoring the pressure of the gas stream leaving the vessel and opening the valve means controlling the third line to vent gas through the flare stack when a predetermined flow rate value is exceeded and closing the third line valve means when the pressure diminishes beneath the predetermined value;

conveying produced gas from the vessel outlet through the second line to the separating means and separating sufficient entrained solids and liquid to produce cleaned gas acceptable as compressor feed;

conveying the cleaned gas from the separating means to the compressor inlet through the fourth line and compressing the cleaned gas to re-injection pressure; and conveying the compressed cleaned gas through the fifth line and reinjecting it into the well through the inlet means.

3. The method as set forth in claim 2 comprising:

opening the valve means controlling the sixth line to add make-up added gas to the cleaned gas when the flow rate of the gas stream leaving the vessel falls below a predetermined value.

* * * * *